US010549911B2

(12) United States Patent
Stetson

(10) Patent No.: US 10,549,911 B2
(45) Date of Patent: Feb. 4, 2020

(54) LINED WASTE RECEPTACLE ASSEMBLY

(71) Applicant: Allen Stetson, Dallas, TX (US)

(72) Inventor: Allen Stetson, Dallas, TX (US)

( * ) Notice: Subject to any disclaimer, the term of this patent is extended or adjusted under 35 U.S.C. 154(b) by 0 days.

(21) Appl. No.: 15/978,876

(22) Filed: May 14, 2018

(65) Prior Publication Data

US 2019/0344962 A1 Nov. 14, 2019

(51) Int. Cl.
*B65F 1/14* (2006.01)
*B65F 1/06* (2006.01)

(52) U.S. Cl.
CPC ..... *B65F 1/1415* (2013.01); *B65F 1/06* (2013.01)

(58) Field of Classification Search
CPC ..... B65F 1/04; B65F 1/065; B65F 2001/061; B65F 1/1415; B65F 1/0073; B65F 1/002; B65F 1/06; B65F 1/062; B65F 1/068
See application file for complete search history.

(56) References Cited

U.S. PATENT DOCUMENTS 449,912 A 4/1891 Oldenbusch
3,130,853 A 4/1964 Coltthurst
3,528,718 A * 9/1970 Braun ..... A47B 77/18 312/270.3
5,125,605 A 6/1992 Guerrera
5,803,299 A * 9/1998 Sealy, Jr. ..... B65F 1/062 220/495.07
5,915,584 A 6/1999 Sposit
8,540,106 B2 9/2013 Banus
2004/0200938 A1 10/2004 Forlivio
2006/0175475 A1* 8/2006 Desantis ..... B65B 67/12 248/99

* cited by examiner

*Primary Examiner* — Jeffrey R Allen

(57) ABSTRACT

A lined waste receptacle assembly includes a container and a frame. The container comprises a wall that extends annularly from a bottom to a top. The top is open so that the container is configured to receive waste items inserted through the top. The frame is annular and defines an opening. The frame is sized so that opposing ends of the frame extend past a perimeter of the top. The frame is positioned to rest on the wall with the opening positioned over the top. Each of a pair of couplers is coupled to the frame proximate to a respective opposing end. Each coupler is configured to selectively couple to a respective strap of a bag as the bag is inserted through the opening and the top into the container. The bag is positioned to receive the waste items.

7 Claims, 4 Drawing Sheets

LINED WASTE RECEPTACLE ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

(2) Description of Related Art Including Information Disclosed Under 37 CFR 1.97 and 1.98

The disclosure and prior art relates to receptacle assemblies and more particularly pertains to a new receptacle assembly for receiving waste.

(h) BRIEF SUMMARY OF THE INVENTION

An embodiment of the disclosure meets the needs presented above by generally comprising a container and a frame. The container comprises a wall that extends annularly from a bottom to a top. The top is open so that the container is configured to receive waste items inserted through the top. The frame is annular and defines an opening. The frame is sized so that opposing ends of the frame extend past a perimeter of the top. The frame is positioned to rest on the wall with the opening positioned over the top. Each of a pair of couplers is coupled to the frame proximate to a respective opposing end. Each coupler is configured to selectively couple to a respective strap of a bag as the bag is inserted through the opening and the top into the container. The bag is positioned to receive the waste items.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
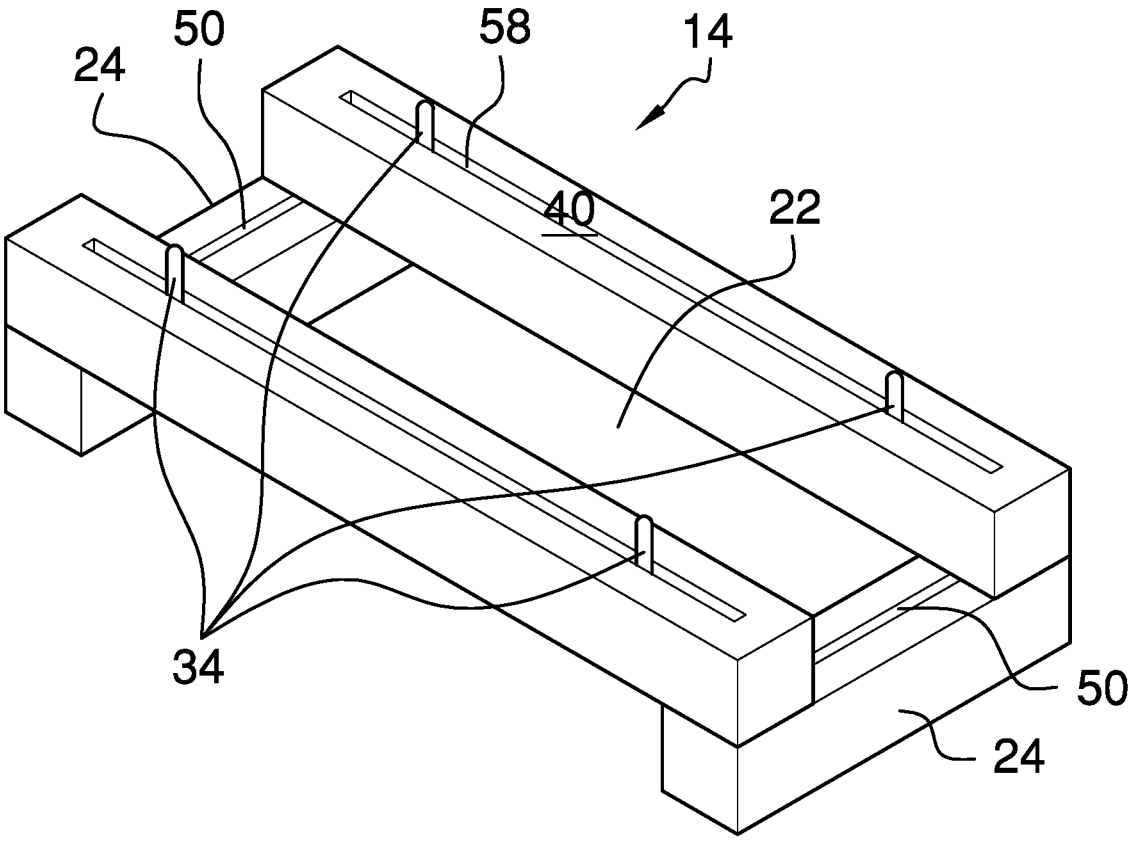
FIG. 1 is an isometric perspective view of a lined waste receptacle assembly according to an embodiment of the disclosure.

With reference now to the drawings, and in particular to FIGS. 1 through 5 thereof, a new receptacle assembly embodying the principles and concepts of an embodiment of the disclosure and generally designated by the reference numeral 10 will be described.

As best illustrated in FIGS. 1 through 5, the lined waste receptacle assembly 10 generally comprises a container 12 and a frame 14. The container 12 comprises a wall 16 that extends annularly from a bottom 18 to a top 20. The top 20 is open so that the container 12 is configured to receive waste items, such as trash and recyclable materials, that are inserted through the top 20.

The frame 14 is annular and defines an opening 22. The frame 14 is sized so that opposing ends 24 of the frame 14 extend past a perimeter 26 of the top 20. The frame 14 is positioned to rest on the wall 16 with the opening 22 positioned over the top 20, as shown in FIG. 56. The frame 14 is tubular.

Figure 2:
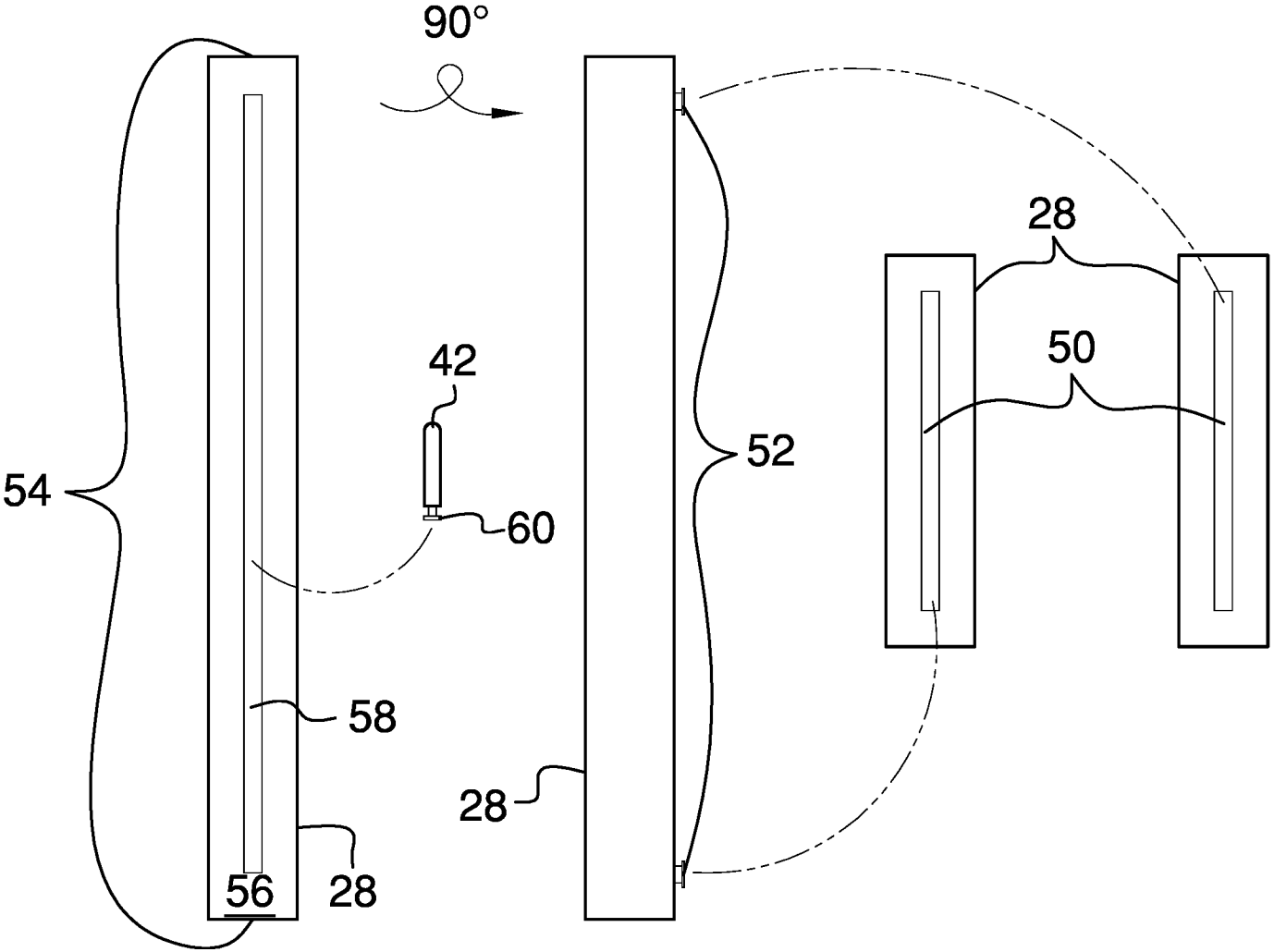
FIG. 2 is an exploded view of an embodiment of the disclosure.
Figure 3:
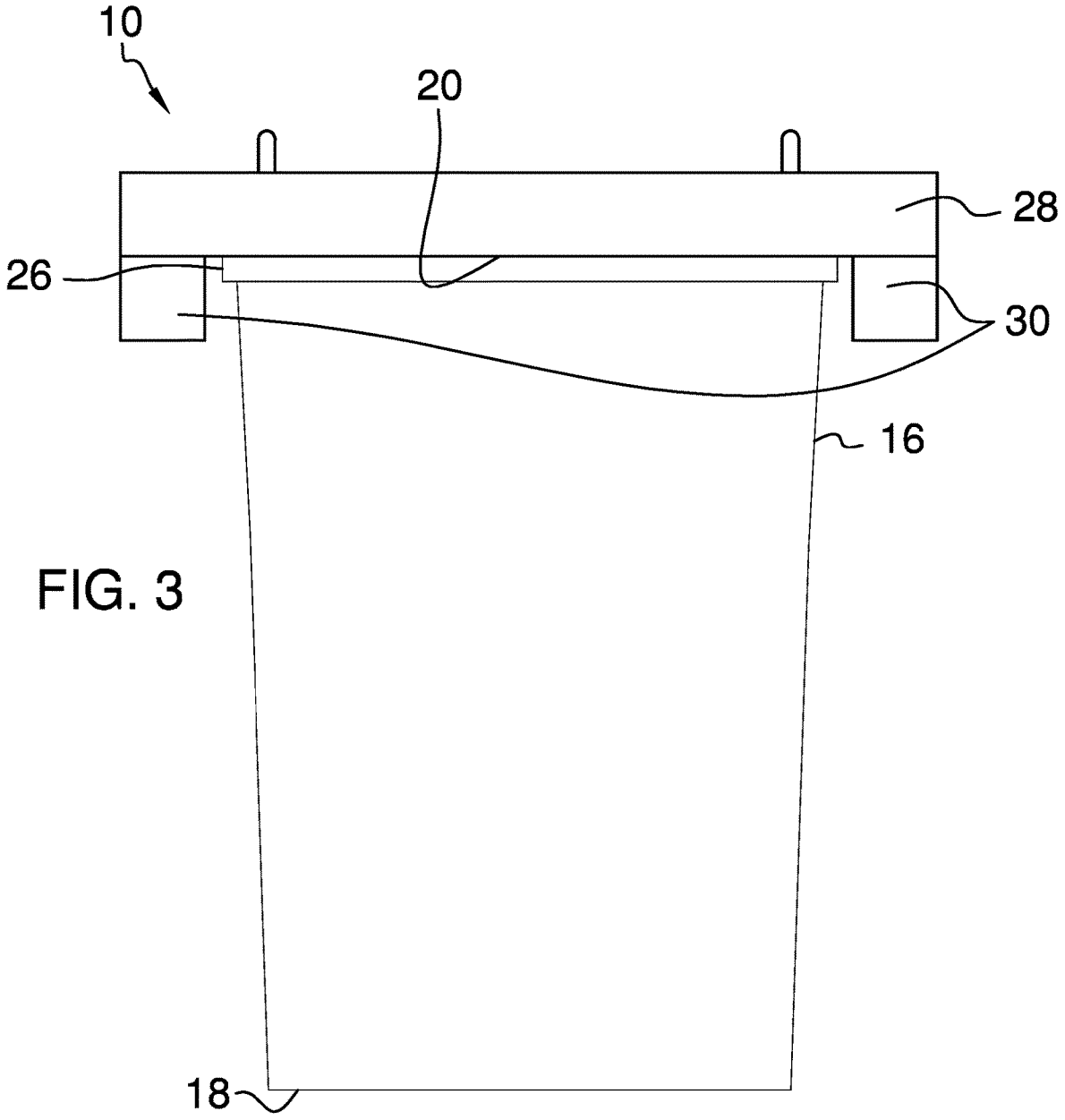
FIG. 3 is a side view of an embodiment of the disclosure.
Figure 4:
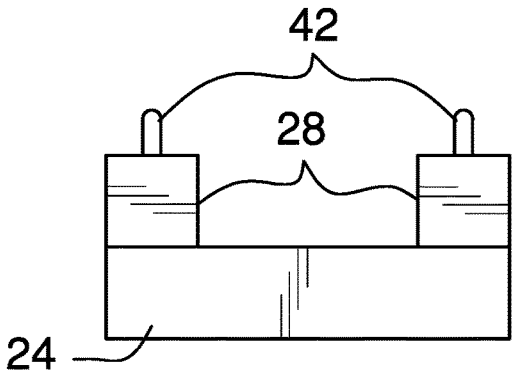
FIG. 4 is an end view of an embodiment of the disclosure.

The frame 14 comprises a pair of side members 28 and a pair of end members 30. Each end member 30 is coupled to and extends between the pair of side members 28 proximate to a respective opposing end 24 of the frame 14. The end members 30 are coupled to a lower face 32 of the pair of side members 28. Each end member 30 is positioned to abut the perimeter 26 of the top 20 to couple the frame 14 to the container 12, as shown in FIG. 3. Each side member 28 and each end member 30 is linear so that the opening 22 is rectangularly shaped, as shown in FIG. 2. Each side member 28 and each end member 30 is squarely shaped when viewed longitudinally.

Each of a pair of recesses 50 is positioned longitudinally in an upper surface 40 of a respective said end member 30. Each of a set of tabs 52 is coupled to and extends from a respective side member 28 proximate to an opposing terminus 54 of the respective side member 28. The tabs 52 are positioned in the recesses 50 so that the side members 28 are slidably coupled to the end members 30. The opening 22 is selectively sizable.

Each of a pair of couplers 34 is coupled to the frame 14 proximate to a respective opposing end 24 of the frame 14. Each coupler 34 is configured to selectively couple to a respective strap 36 of a bag 38, such as a plastic grocery sack, as the bag 38 is inserted through the opening 22 and the top 20 into the container 12. The bag 38 is positioned to receive the waste items. The couplers 34 are positioned on the upper face 40 of the pair of side members 28.

Figure 5:
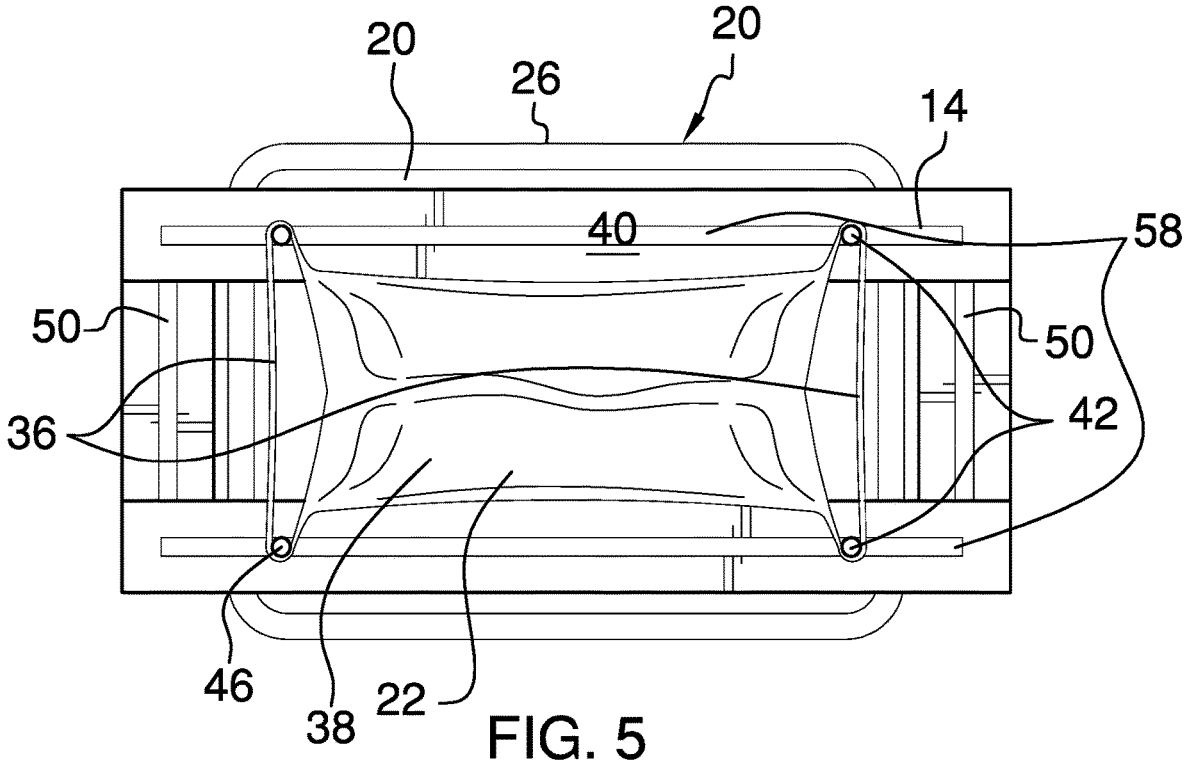
FIG. 5 is a top view of an embodiment of the disclosure.

Each coupler 34 comprises a pair of pegs 42, or the like. Each peg 42 of the pair of pegs 42 is coupled to and extends perpendicularly from the upper face 40 of the pair of side members 28. The pair of pegs 42 is positioned to couple to a respective strap 36 of the bag 38 to couple the bag 38 to the frame 14. The bag 38 is positioned in a substantially open configuration, as shown in FIG. 5.

A pair of slots 58 is positioned in the upper face 40 of the pair of side members 28. Each slot 58 is positioned longitudinally in a respective side member 28. Each of a set of extrusions 60 is coupled to and extends from a respective peg 42 into an associated slot 58 so that the respective peg 42 is slidably coupled to the respective side member 28. The pegs are selectively positionable between the opposing termini 54 of the side members 28.

In use, the frame 14 is positioned on the wall 16 with the opening 22 positioned over the top 20. The end members 30 abut the perimeter 26 of the top 20 to couple the frame 14 to the container 12. Each pair of pegs 42 is positioned to couple to a respective strap 36 of the bag 38 to couple the bag 38 to the frame 14. The discs 46 are positioned to deter slippage of straps 36 from the rods 44. The bag 38 is positioned in the substantially open configuration and is positioned to receive the waste items.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

The invention claimed is:

1. A lined waste receptacle assembly comprising:

a container comprising a wall extending annularly from a bottom to a top, said top being open wherein said container is configured for receiving waste items inserted through said top;

a frame, said frame being annular such that said frame defines an opening, said frame being sized such that opposing ends of said frame extend past a perimeter of said top such that said frame is positioned for resting on said wall with said opening positioned over said top, said frame comprising a pair of side members, and a pair of end members, each said end member being coupled to and extending between said pair of side members proximate to a respective said opposing end of said frame; and a pair of couplers, each said coupler being coupled to said frame proximate to a respective said opposing end, each said coupler being configured for selectively coupling to a respective strap of a bag as said bag is inserted through said opening and said top into said container positioning said bag for receiving the waste items, said couplers being positioned on an upper face of said pair of side members, each said coupler comprising a pair of pegs, each peg of said pair of pegs being coupled to and extending perpendicularly from said upper face of said pair of side members such that said pair of pegs is positioned for coupling to a respective said strap for coupling said bag to said frame positioning said bag in a substantially open configuration;

a pair of slots positioned in said upper face of said pair of side members, each said slot being positioned longitudinally in a respective said side member; and a set of extrusions, each said extrusion being coupled to and extending from a respective said peg into an associated said slot such that said respective said peg is slidably coupled to said respective said side member.

2. The assembly of claim 1, further including said frame being tubular.

3. The assembly of claim 1, further including said end members being coupled to a lower face of said pair of side members such that each said end member is positioned for abutting said perimeter of said top for coupling said frame to said container.

4. The assembly of claim 1, further including each said side member and each said end member being linear such that said opening is rectangularly shaped.

5. The assembly of claim 1, further including each said side member and each said end member being squarely shaped when viewed longitudinally.

6. The assembly of claim 5, further comprising:

a pair of recesses, each said recess being positioned longitudinally in an upper surface of a respective said end member, and a set of tabs, each said tab being coupled to and extending from a respective said side member proximate to an opposing terminus of said respective said side member, said tabs being positioned in said recesses such that said side members are slidably coupled to said end members wherein said opening is selectively sizable.

7. A lined waste receptacle assembly comprising:

a container comprising a wall extending annularly from a bottom to a top, said top being open wherein said container is configured for receiving waste items inserted through said top;

a frame, said frame being annular such that said frame defines an opening, said frame being sized such that opposing ends of said frame extend past a perimeter of said top such that said frame is positioned for resting on said wall with said opening positioned over said top, said frame being tubular, said frame comprising:

a pair of side members, a pair of end members, each said end member being coupled to and extending between said pair of side members proximate to a respective said opposing end of said frame, said end members being coupled to a lower face of said pair of side members such that each said end member is positioned for abutting said perimeter of said top for coupling said frame to said container, each said side member and each said end member being linear such that said opening is rectangularly shaped, each said side member and each said end member being squarely shaped when viewed longitudinally, a pair of recesses, each said recess being positioned longitudinally in an upper surface of a respective said end member, and a set of tabs, each said tab being coupled to and extending from a respective said side member proximate to an opposing terminus of said respective said side member, said tabs being positioned in said recesses such that said side members are slidably coupled to said end members wherein said opening is selectively sizable;

a pair of couplers, each said coupler being coupled to said frame proximate to a respective said opposing end, each said coupler being configured for selectively coupling to a respective strap of a bag as said bag is inserted through said opening and said top into said container positioning said bag for receiving the waste items, said couplers being positioned on an upper face of said pair of side members, each said coupler comprising a pair of pegs, each peg of said pair of pegs being coupled to and extending perpendicularly from said upper face of said pair of side members such that said pair of pegs is positioned for coupling to a respective said strap for coupling said bag to said frame positioning said bag in a substantially open configuration a pair of slots positioned in said upper face of said pair of side members, each said slot being positioned longitudinally in a respective said side member; and a set of extrusions, each said extrusion being coupled to and extending from a respective said peg into an associated said slot such that said respective said peg is slidably coupled to said respective said side member.

* * * * *